US010487283B1

(12) United States Patent
Jamaluddin et al.

(10) Patent No.: US 10,487,283 B1
(45) Date of Patent: Nov. 26, 2019

(54) REGENERATIVE THERMAL OXIDIZER WITH SECONDARY AND TERTIARY HEAT RECOVERY

(71) Applicant: EPCON Industrial Systems, LP, Conroe, TX (US)

(72) Inventors: Aziz A. Jamaluddin, The Woodlands, TX (US); Brian Wendt, Spring, TX (US); Vipul Patel, Shenandoah, TX (US)

(73) Assignee: EPCON INDUSTRIAL SYSTEMS, LP, Conroe, TX (US)

( * ) Notice: Subject to any disclaimer, the term of this patent is extended or adjusted under 35 U.S.C. 154(b) by 140 days.

(21) Appl. No.: 15/926,801

(22) Filed: Mar. 20, 2018

(51) Int. Cl.
*C10L 10/06* (2006.01)
*C10L 1/04* (2006.01)
*F23J 7/00* (2006.01)

(52) U.S. Cl.
CPC ..... *C10L 10/06* (2013.01); *C10L 1/04* (2013.01); *F23J 7/00* (2013.01); *C10L 2290/24* (2013.01)

(58) Field of Classification Search
CPC ..... C10L 10/06; C10L 1/04; C10L 2290/24; F23J 7/00
See application file for complete search history.

(56) References Cited

U.S. PATENT DOCUMENTS

| | | | |
|---|---|---|---|
| RE15,316 | E | 3/1922 | Weiss |
| 1,593,598 | A | 7/1926 | Redman |
| 2,270,815 | A | 1/1942 | Vaughan |
| 2,463,782 | A | 3/1949 | Leischner |
| 3,470,623 | A | 10/1969 | Hildebrand |
| 4,240,787 | A | 12/1980 | Jamaluddin |
| 4,242,084 | A | 12/1980 | Jamaluddin |
| 4,299,036 | A | 11/1981 | Schregenberger |
| 4,322,203 | A | 3/1982 | Jamaluddin |
| 6,135,765 | A | 10/2000 | Jamaluddin |
| 6,149,707 | A | 11/2000 | Jamaluddin |

(Continued)

FOREIGN PATENT DOCUMENTS

| | | |
|---|---|---|
| EP | 1570710 B1 | 5/2006 |
| WO | 0053985 A1 | 9/2000 |

OTHER PUBLICATIONS

Tube-O-Therm(R) Low Temperature Gas Burners brochure, MAXON Corporation, 2012, p. 1-6.

*Primary Examiner* — Alfred Basichas
(74) *Attorney, Agent, or Firm* — Jeffrey L. Wendt; The Wendt Firm, P.C.

(57) ABSTRACT

In a first cycle, an effluent gas composition including volatile organic compounds flows into a first vessel having heated ceramic material therein, forming a heated effluent composition, which then flows into a combustion/retention chamber connected to the first vessel, the combustion/retention chamber comprising a burner, which combusts VOCs in heated effluent composition. The hydrocarbon-depleted heated effluent composition flows into a second vessel with a second ceramic material therein, and heat transferred thereto. A hydrocarbon-depleted first cycle cooled effluent composition is directed into a first indirect heat exchanger, transferring heat to a very low VOC airstream. The heated very low VOC airstream is then directed into a unit designed to employ the heated very VOC airstream for heating. The effluent composition is then directed into a second indirect heat exchanger, transferring heat to a water stream. The direction of flow is reversed in a second cycle, while a third vessel is purged.

20 Claims, 7 Drawing Sheets

(56) References Cited

U.S. PATENT DOCUMENTS

| | | | |
|---|---|---|---|
| 7,018,201 | B1 | 3/2006 | Pierce et al. |
| 8,881,425 | B2 | 11/2014 | Latos |
| 9,200,834 | B1 | 12/2015 | Ball, Jr. et al. |
| 9,726,429 | B1 | 8/2017 | Jamaluddin et al. |
| 2017/0219286 | A1 | 8/2017 | Jamaluddin et al. |
| 2017/0241013 | A1 | 8/2017 | Jamaluddin |

REGENERATIVE THERMAL OXIDIZER WITH SECONDARY AND TERTIARY HEAT RECOVERY

BACKGROUND INFORMATION

Technical Field

The present disclosure relates generally to the field of industrial ovens, especially baking or curing ovens for painted or coated products. The invention is particularly concerned with an arrangement of industrial ovens having a system of air pollution control and heat recovery including a regenerative thermal oxidizer.

Background Art

In painting or coating industrial products, such as metal coils, pipes, drums and the like, it is well known to use gas-fired ovens which will dry painted or coated products and yield a gaseous effluent containing a substantial amount of combustible constituents such as hydrocarbons. Such ovens may be operated at low temperature, intermediate temperature, or high temperature, depending upon the type of coating and the particular stage in the processing of the coated product. It is common in the operation of industrial ovens to vent the gaseous effluent from individual ovens into separate fume incinerators. It is also known to recover heat from the operation of industrial ovens and also to recover heat from the combustion of combustible products which are contaminants from a baking or curing oven effluent.

In a previous patent (U.S. Pat. No. 4,242,984) arrangements were described which allowed substantially complete elimination of combustible constituents in the off gasses from treating ovens and which provide for substantially total heat recovery at the same time. However, the use of less energy remains a concern today.

In certain arts, such as the glass melting art, it is known to use recuperative and/or regenerative heat recovery. Recuperative heat recovery employs one or more heat exchangers to preheat fuel and/or oxidant to furnaces, or to preheat drying air to drying ovens. Regenerative furnaces are where flow direction of an otherwise waste heat stream is periodically reversed through what are essentially packed beds comprised of ceramic material, usually ceramic, brick, or stone pieces, to preheat fuel and/or oxidant to furnaces, or to produce heated air for drying. In the glass melting art these are referred to as "checkers." While fairly efficient for heat recovery, this technique either requires manual switching of flow direction, which would be counterproductive or even hazardous if left un-switched, or complicated, expensive controllers and algorithms based on moisture sensors, temperature sensors, and the like. Regenerative heat recovery is also not known for use in transferring heat form ceramic materials to gas streams containing hydrocarbons and/or VOCs, due to safety concerns. This limits the applicability of the technique to a limited number of operations where air is preheated.

It would be an advanced in the industrial oven art, especially baking or curing ovens for painted or coated products, coating oven effluents, coating rooms, spray booths, and the like to improve energy usage and/or safety while maintaining air pollution control.

SUMMARY

In accordance with the present disclosure, methods and systems allowing air pollution control and heat recovery are that may reduce or eliminate problems with known methods and systems. In certain methods and systems of the present disclosure, combustible constituents, such as hydrocarbons and/or VOCs in the exhaust air stream from industrial ovens may be substantially completely combusted (preferably completely combusted to $CO_2$ and $H_2O$) and the heat of combustion substantially completely recovered (preferably completely recovered). A plurality of paint bake ovens (or ovens for other purposes) of various capacities, lengths, and heat input may be provided for multi-stage processing in the manufacture of various types of equipment, for example painted metal drums and lids. In such processes, a supply of high temperature, high pressure water may be provided for multi-stage cleaning and rinsing in the manufacturing operation prior to the painting booths or rooms. The combined exhaust from all of the processing ovens may be collected at a rate providing a combustible constituent content of about 25% LEL (lower explosive limit), and through use of one of the methods and systems of this disclosure, there is substantially complete recovery of heat and the gases discharged to atmosphere meet air quality standards with less energy cost than in previous systems not using regenerative heat exchange.

One aspect of the disclosure is a method comprising (or consisting of, or consisting essentially of):

(a) in a first cycle, flowing an effluent composition comprising hydrocarbons and/or volatile organic compounds at an initial temperature into a first vessel having a first bed of ceramic material therein thereby contacting the effluent composition with the first bed of ceramic material, transferring heat to the effluent composition from the first bed of ceramic material, forming a first cycle heated effluent composition at a first heated temperature and a cooled first bed of ceramic material;

(b) flowing the first cycle heated effluent composition into a combustion/retention chamber above and fluidly connected to the first vessel, the combustion/retention chamber comprising at least one combustion burner;

(c) combusting at least some of the hydrocarbons and/or VOCs in the first cycle heated effluent composition in a flame of the at least one burner to form a hydrocarbon-depleted first cycle heated effluent composition having a second heated temperature;

(d) flowing the hydrocarbon-depleted first cycle heated effluent composition into a second vessel having a second bed of same or different ceramic material therein, thereby contacting the hydrocarbon-depleted first cycle heated effluent composition with the second bed of ceramic material, transferring heat from the hydrocarbon-depleted first cycle heated effluent composition to the second bed of ceramic material and forming a hydrocarbon-depleted first cycle cooled effluent composition having a first cooled temperature;

(e) flowing the hydrocarbon-depleted first cycle cooled effluent composition into a first indirect heat exchanger, transferring heat from the hydrocarbon-depleted first cycle cooled effluent composition to a very low VOC airstream also flowing through the first indirect heat exchanger, forming a hydrocarbon-depleted first cycle second cooled effluent composition having a second cooled temperature and a heated very low VOC airstream;

(f) flowing the heated very low VOC airstream into a unit operation designed to employ the heated very VOC airstream for heating one or more components;

(g) flowing the hydrocarbon-depleted first cycle second cooled effluent composition into a second indirect heat exchanger, transferring heat from the hydrocarbon-depleted first cycle second cooled effluent composition to a water stream also flowing through the second indirect heat exchanger, forming a hydrocarbon-depleted first cycle third cooled effluent composition and a warmed water stream.

Certain method embodiments may comprise flowing a clean purge airstream through a third vessel having a third bed of same or different ceramic material therein, thereby purging the third bed of ceramic material of detritus collected therein and forming a dirty purge stream, and routing the dirty purge stream into the combustion/retention chamber for combusting at least some of the detritus.

Certain method embodiments may comprise a second cycle, reversing flow through the first and second vessels so that the effluent composition flows first through the second vessel, creating a second cycle heated effluent composition and a cooled second bed of ceramic material, the second heated effluent composition flowing into the combustion/retention chamber where some of the hydrocarbons/VOCs are consumed to form a hydrocarbon-depleted second cycle heated effluent composition.

In certain method embodiments the combustion/retention chamber may comprise a structure encompassing an upper end of the first vessel and an upper end of the second vessel, and confines flow of the effluent composition and the first cycle heated effluent composition therein.

Certain method embodiments may comprise wherein the combustion/retention chamber encompasses an upper end of the first vessel, an upper end of the second vessel, and an upper end of the third vessel, the combustion/retention chamber confining flow of the effluent composition, the first cycle heated effluent composition, and the dirty purge stream therein.

Certain method embodiments may comprise wherein the combustion/retention chamber is maintained at a temperature ranging from about 700° C. to about 900° C. (from about 1290° F. to about 1650° F.), or from about 760° C. to about 815° C. (from about 1400° F. to about 1500° F.), in certain embodiments using one or more temperature sensors, thermostats, dampers, and sources of fresh ambient temperature air (ambient temperature as used herein means temperatures ranging from about 20 to about 25° C., although ambient temperatures lower and higher than these may be contemplated.

Certain method embodiments may comprise wherein the detritus in the dirty purge stream is combusted in the combustion/retention chamber and contributes to forming the hydrocarbon-depleted first cycle heated effluent composition.

Certain method embodiments may comprise operating the first cycle and the second cycle so that the first cycle operates for a first time period ranging from about 120 to about 300 seconds, and the second cycle operates for a second time period ranging from about 120 to about 300 seconds, and repeating the first cycle and the second cycle for a plurality of the first cycles and a plurality of the second cycles, whereby a sum of the first time periods and the second time periods equals a total time not less than one hour.

Certain method embodiments may comprise, or consist essentially of, or consist of a third cycle after the total time has expired comprising switching the flowing of the clean purge airstream from flowing through the third vessel having the third bed of same or different ceramic material therein to flowing the clean purge airstream through the first vessel and the first bed of ceramic material, while simultaneously switching the flowing of the effluent composition to flow through the third vessel and the third bed of ceramic material, thereby purging the first bed of ceramic material of detritus collected therein and forming a second dirty purge stream, routing the second dirty purge stream into the combustion/retention chamber for combusting at least some of detritus in the second dirty purge stream.

Another aspect of the disclosure is a system (sometimes referred to herein as an "RTO with secondary and tertiary heat recovery" or an "RTO pollution control system with secondary and tertiary heat recovery sub-systems") comprising (or consisting essentially of, or consisting of):

(a) a regenerative thermal oxidizer (RTO), the RTO comprising at least three vessels open at their top to a common combustion/retention chamber, the combustion/retention chamber comprising at least one combustion burner configured to combust materials inside the combustion/retention chamber, the at least three vessels comprising a first vessel, a second vessel and a third vessel, each of the first, second, and third vessels having a same or different bed of ceramic material therein;

(b) a first indirect heat exchanger fluidly connected to the RTO via an RTO outlet conduit, the first indirect heat exchanger configured to be fluidly connected to a source of low VOC air via a low VOC source conduit, and configured to be fluidly connected to a unit operation requiring heated air by a heated low VOC air conduit;

(c) a second indirect heat exchanger fluidly connected to the first indirect heat exchanger via a first cooled effluent composition conduit, the second indirect heat exchanger configured to be fluidly connected to a stack via a second cooled effluent composition conduit;

(e) a manifold and valving sub-assembly comprising an inlet manifold and an outlet manifold, each of the inlet manifold and the outlet manifold having valves sufficient to alternate flow to and from the first vessel, the second vessel, and the third vessel of the RTO in a regenerative heat transfer and pollution reduction process, wherein the manifold and valving sub-assembly is configured to operate at least one of the vessels in a purge mode, whereby purged material is exhausted into the combustion/retention chamber.

Certain system embodiments may comprise a hot gas bypass conduit and damper (preferably a thermostatic damper controlled by a thermostat) fluidly connecting the combustion/retention chamber and the RTO outlet conduit Certain system embodiments may comprise an RTO exhaust and hot gas bypass mixing chamber fluidly connected to the RTO outlet conduit, the hot gas bypass conduit, and a mixed stream conduit fluidly connecting the mixing chamber with the first indirect heat exchanger.

Certain system embodiments may comprise a process bypass conduit and control valve fluidly connecting the RTO inlet conduit and the heated low VOC air conduit.

Certain system embodiments may comprise an auxiliary burner configured to exhaust into the heated low VOC air conduit.

Certain system embodiments may comprise the second indirect heat exchanger fluidly connected to a water source conduit, a coil, and a heated water outlet conduit.

In certain system embodiments the one or more combustion burners may be attached to the structure forming the combustion/retention chamber externally thereof and may comprise a right-side burner and a left-side burner attached respectively to opposing left and right walls of the structure, attached in this sense meaning attached directly to the walls of the structure, with no intervening structure or conduit other than possibly a support bracket, platform or the like. In certain system embodiments the combustion burners may be nozzle-mix, gas fired, ceramic-less burners.

In certain system embodiments the combustion/retention chamber and heat exchange sub-systems may comprise one or more structures (baffles, distributor plates, grids, and the like) for causing a tortuous flow path for the stream flowing therethrough, for example around tubular members of an indirect heat exchange substructure.

Methods and systems of this disclosure will become more apparent upon review of the brief description of the drawings, the detailed description of the disclosure, and the claims that follow.

BRIEF DESCRIPTION OF THE DRAWINGS

The manner in which the objectives of the disclosure and other desirable characteristics can be obtained is explained in the following description and attached drawings in which.

Figure 1:
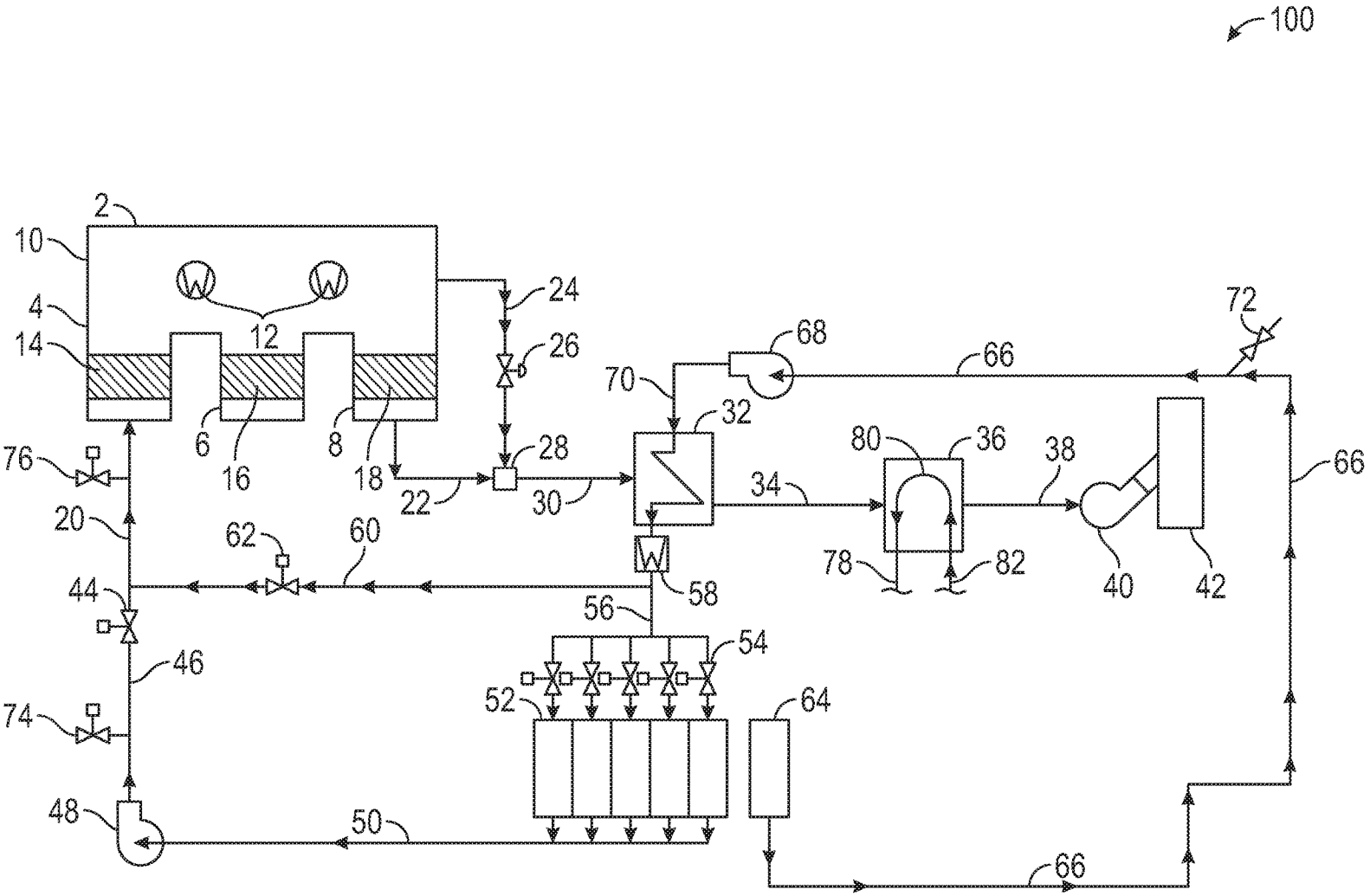
FIGS. 1, 2, 3, and 4 are schematic process flow diagrams of four alternative method and system embodiments in accordance with the present disclosure.
Figure 2:
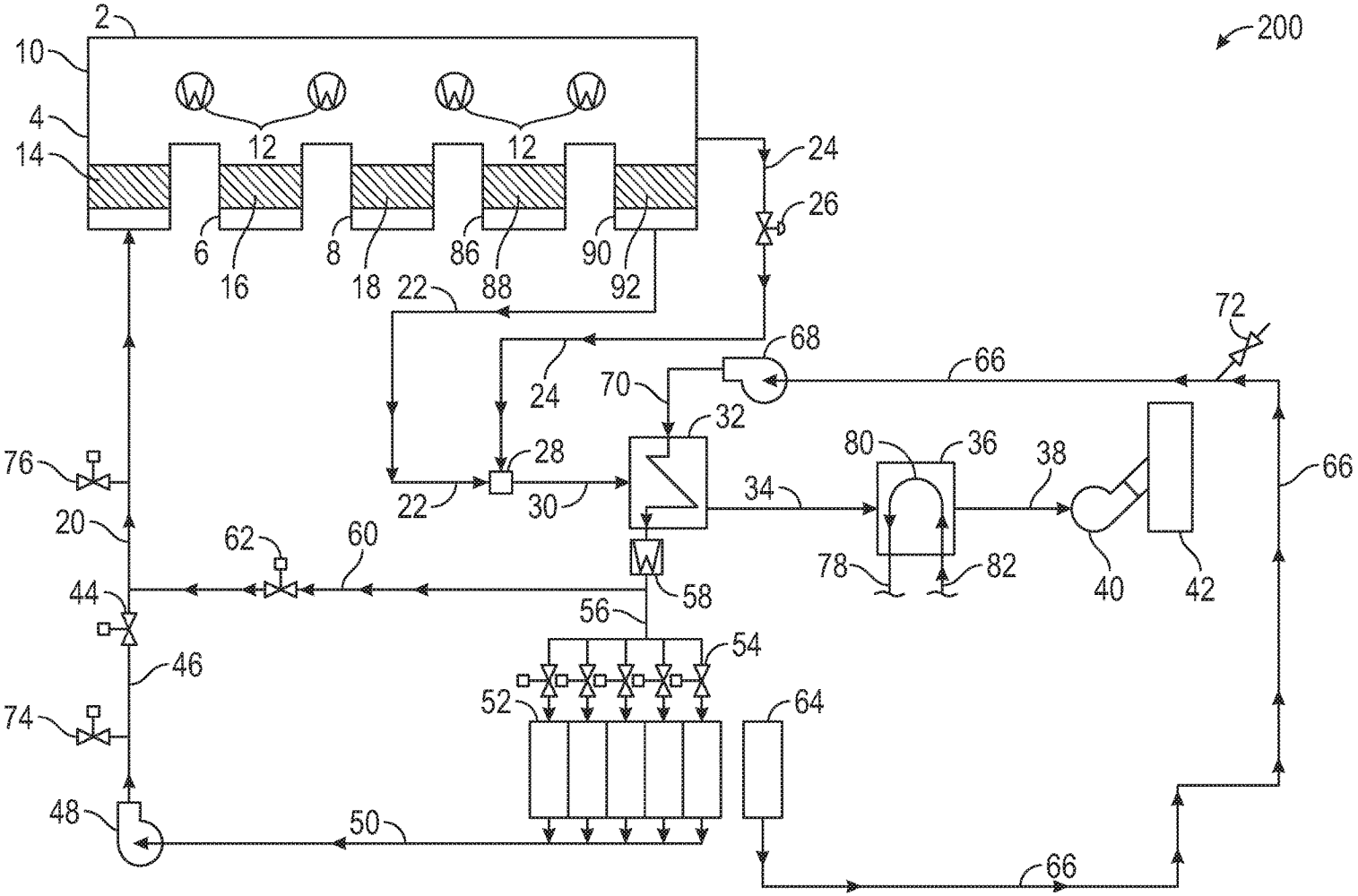

It is to be noted, however, that the appended drawings are schematic in nature, may not be to scale (in particular FIGS. 1-5), and illustrate only typical embodiments of this disclosure and are therefore not to be considered limiting of its scope, for the disclosure may admit to other equally effective embodiments.

DETAILED DESCRIPTION

In the following description, numerous details are set forth to provide an understanding of the disclosed methods and systems. However, it will be understood by those skilled in the art that the methods and systems covered by the claims and otherwise described herein may be practiced without these details and that numerous variations or modifications from the specifically described embodiments may be possible and are deemed within the claims. For example, it will be understood that wherever the term "comprising" is used, other embodiments and/or components and/or steps where "consisting essentially of" and "consisting of" may be substituted for "comprising" are explicitly disclosed herein and are part of this disclosure. Moreover, the use of negative limitations is specifically contemplated; for example, certain systems and methods may comprise a number of physical hardware and software components and features, but may be devoid of certain optional hardware and/or software and/or other features, such as one or more manifolds, valves, bypass conduits, thermostats, and temperature and flow sensors. As another example, certain servers suitable for use herein may include computer software and hardware components pertinent to particular end uses, but may be devoid of other components and/or software, depending on the wishes of the design, facility owner, or other end user. Computers and servers may, in certain embodiments, be devoid of any other use than for use in or with the aspects of this disclosure. All published patent applications and patents referenced herein are hereby explicitly incorporated herein by reference. In the event definitions of terms in the referenced patents and applications conflict with how those terms are defined in the present application, the definitions for those terms that are provided in the present application shall be deemed controlling.

As explained briefly in the Background, in a previous patent (U.S. Pat. No. 4,242,984) arrangements were described which allowed substantially complete elimination of combustible constituents in the off gasses from treating ovens and which provide for substantially total heat recovery at the same time. However, the use of less energy remains a concern today. While fairly efficient for that time for removing VOC and/or HAPs, and heat recovery, the systems described in the '984 patent did not employ regenerative heat recovery. Furthermore, those systems and methods formed a heated water stream that was then mixed with a cold water stream and then stored, which wastes some of the thermal energy in the heated water, as it is cooled without benefit to the plant.

In contrast, the methods and systems of the present disclosure present a new technology and concept to destroy the hydrocarbons also known as Volatile Organic compounds (VOC) or Hazardous Air Pollutant (HAPs), coming from a source, generally, from a process oven or furnace, which could be a baking oven, curing oven, or initiated from a process at any temperature including atmospheric temperature or temperatures ranging from 40° C. to 650° C. (100° F. to 1200° F.). Higher temperature process effluent compositions generally emanate from industrial ovens of some sort, primarily one oven or multiple ovens, and generally the exhaust is treated prior to discharging to the atmosphere; essentially, any industrial oven (for example sheet metal coating ovens) where a continuous automated process of coating metal before fabrication into end products has an exhaust stream that may be processed in accordance with the methods and systems of the present disclosure. Typically, a steel or aluminum substrate is delivered in coil form from a rolling mill to a coating plant for coating. Another example is a 55-gallon drum manufacturing plant, where the drums and lids must be cleaned and painted. Essentially any manufacturing operation where coatings are applied in one or multiple phases may benefit form the methods and systems of the present disclosure.

Sometimes the process involves a primer oven and finish oven, such as any curing applications of metal parts, where the coated parts go through a process of curing a primary coating and the top or finish coating after a paint or other coating is applied on metal part.

Typical examples are: metal coating operations, pipe coating, flexible packaging manufacturing, printing operation, web processing, and the like. Ultimately, the process effluent may be initiated from any source of manufacturing, refinery or petrochemical industry operation.

It would be an advanced in the metal coating and curing arts, and in particular the art of combustion-based heat treating of metals and metallic products, to improve energy usage and/or safety while destroying substantially all (or preferably all) VOCs and/or HAPs in effluent compositions prior to releasing the effluent compositions to the atmosphere. The present application is devoted to resolving one or more of these challenges.

In more depth, the present disclosure describes a combination of pollution control equipment (a regenerative thermal oxidizer, in this particular instance, herein referred to as an "RTO") with primary heat recovery, secondary and tertiary heat recoveries. Certain system and method embodiments feature unique arrangements of cascading the air flow from one or more sources of contaminated air, such one or more coating ovens and one or more coating rooms, spray booths, and the like, using an RTO and secondary and tertiary heat recovery sub-systems that help to achieve maximum possible heat conservation through overall system arrangement.

The RTO, sometimes referred to herein as the primary heat recovery sub-system, may comprise multiple (in certain embodiments, and odd number such as 3, 5, 7, 9, n) energy recovery towers or vessels packed with ceramic, preferably ceramic material which essentially act as heat exchangers. The ceramic packing material has unique properties of holding and releasing the heat. In certain methods and systems, the flow reversal (cycling) principle is used to direct an "effluent composition" (for example, air contaminated with hydrocarbons and/or VOCs and/or HAPS emanating from a coating room) flow from one of the energy recovery towers or vessels to another on a periodic basis, which in certain embodiments may range from about 100 to about 300 seconds, or from about 150 seconds to about 180 seconds.

During a first cycle, cold dirty effluent composition enters a first energy recovery tower (referred as Canister or Vessel 1) and absorbs the heat stored in the ceramic packing and enters the purification/retention chamber or combustion/retention chamber where one or more combustion burners are installed to add additional heat to the dirty effluent composition. In certain method and system embodiments, the one or more combustion burners maintain a substantially constant temperature set point between (for example, ranging from about 700° C. to about 900° C. (from about 1290° F. to about 1650° F.), or from about 760° C. to about 815° C. (from about 1400° F. to about 1500° F.). In the retention/purification chamber or combustion/retention chamber, substantially all volatile organic compounds (VOCs) or hazardous air pollutant (HAPs) are oxidized in presence of oxygen (either supplied as industrial oxygen, oxygen-enriched air, or air) and form $CO_2$ and $H_2O$, or in some embodiments a combination of CO, $CO_2$, and $H_2O$) which become part of a "modified" or "clean" effluent composition, and which are environmental friendly and safer to discharge to atmosphere than the VOC and HAPs. After leaving the purification/retention chamber or combustion/retention chamber, the now hot, clean effluent composition, which now has a high thermal energy, enters the second energy tower (referred as canister or vessel 2) comprising the same or different ceramic (preferably ceramic) packing material absorbs much of the heat from the heated, modified effluent gases exit gases and stores much of this thermal energy. During the next (second) cycle, with the help of flow reversal valves (referred as flow diverting valves) the incoming effluent composition is diverted from entering vessel 1 and into vessel 2 (which is now a "hot energy tower") to absorb at least some of the heat stored in the hot ceramic packing material and forced to exit through a now cooler vessel 1 to release thermal energy to the ceramic packing therein, and relatively cooler gases exit the system as an RTO exhaust gas stream, also referred to as a clean effluent composition.

In certain embodiments, the exhaust gases leaving RTO system (primary heat recovery) contain significant energy that is further recovered using one or more secondary heat recovery sub-systems, heat exchangers that may be arranged in parallel, series, or combination thereof. In certain embodiments, we utilized air-to-air indirect heat exchangers (metal plate and shell—indirect style) to preheat cold process effluent from another emission source (such as coater room or spray booth), and this preheated process effluent may be supplied as make up heat to the coating ovens as replacement for some of the warm coater room or spray booth exhaust air.

The moderate heat energy still contained in the RTO exhaust gases leaving secondary heat recovery sub-system may be further utilized to heat water or other plant liquid by employing one or more tertiary heat recovery sub-systems, heat exchangers that also may be arranged in parallel, series, or combination thereof. In certain embodiments, one or more gas-to-water heat exchangers (for example, coil and shell indirect heat exchangers, with water passing through the coil) to preheat water that may be supplied as a heat source to a plant.

Various arrangements of primary heat recovery, secondary heat recovery and tertiary heat recovery along with air pollution control system (RTO—Regenerative Thermal Oxidizer) are described herein, and others may be conceived and deployed to achieve optimal operation efficiency and allow an end user to capitalize on the thermal energy across an entire process. The RTO is highly energy efficient and effective air pollution control technology for applications handling large process volume flow rates with very low VOC concentrations such as paint manufacturing, paint finishing, printing and packaging, food processing and many others. The regeneration principle operates around multiple energy recovery chambers or vessels, which serve as housings for ceramic heat recovery media, which acts as a thermal energy storage and heat exchange medium. The multiple chambers operate under a "swing bed" absorption principle: which is the principle of transfer through multiple beds using flow reversal. In the use of this principle with ceramic stoneware or other ceramic material, the process is called regeneration. As the dirty exhaust stream (process effluent composition) travels through the first bed of ceramic material, it absorbs some of the thermal energy stored in the ceramic material mass, which pre-heats the exhaust stream. The exhaust stream then enters the oxidation chamber (also referred as purification/retention chamber, or simply as "the combustion/retention chamber"), where thermal energy is added from one or more combustion burners to reach a desired system operating temperature in the combustion/retention chamber. After the desired system operating temperature has been achieved, the now clean exhaust stream then passes through the second energy recovery chamber or vessel. During the time the combustion/retention chamber is coming up to temperature, the flow goes into one energy recovery chamber (inlet) then into the combustion chamber and then to a second energy recovery chamber and out the stack. This flow pattern reverses every "X" minutes, which we call the RTO Cycle Time. This flow pattern occurs continuously during start-up (heat-up) and operation mode.

As the "clean" exhaust stream passes from the combustion/retention chamber through the second vessel, the cold ceramic material therein absorbs some of the thermal energy of the clean exhaust stream, and stores the absorbed thermal energy for the reverse flow (second cycle) of the method and system. Once the thermal energy of the first vessel has been depleted through contact with incoming dirty exhaust stream, the flow through the system is rotated or reversed, so the incoming dirty exhaust stream is then directed through the second vessel, with the heated exhaust stream in the combustion/retention chamber now going through vessel 1 in reverse direction. In certain embodiments, a third vessel (vessel 3) having same or different ceramic material bed therein remains in purge mode (being purged with ambient air or reduced moisture air, oxygen enriched air, or oxygen-enriched dried air) and exhausted in to the combustion/retention chamber, carrying detritus out of vessel 3.

By using the reversal of flow through vessels 1 and 2 and their respective ceramic material beds, a minimal amount of thermal energy needs to be added to the incoming dirty exhaust stream/process effluent to maintain the combustion/retention chamber's minimum operating temperature. The sizing of the ceramic material, and the size of the beds, is such that up to 80 percent, or 85 percent, or 90 percent, or 95 percent, or 96 percent, or 97 percent heat recovery efficiency is possible through the regenerating, reversal flow process.

What happens within a regenerative thermal oxidizer is intriguing. Gas laden with volatile and hazardous contaminants (alternately referred to herein as "effluent gas" or "dirty process or effluent gas", or simply "process gas" or "process exhaust") enters one vessel/ceramic material bed of a multiple vessel/bed RTO via an inlet manifold. Heating of the process gas continues through the heat exchange media bed (ceramic material bed) as the process gas moves toward the oxidation or purification chamber (combustion/retention chamber).

For RTO applications requiring high destruction rate efficiency (DRE), defined as more than 75 percent, or more than 80 percent, or more than 85 percent, or more than 90 percent, or more than 95 percent, or more than 99 percent destruction of VOCs and HAPs, more than two energy recovery chambers (vessels with ceramic material beds) may be employed where at a given time two (or more) chambers may be engaged in process treatment mode while a third chamber is being operated under cleaning mode (sometimes referred as purging mode). The purge cycle removes the entrapped pollutants within ceramic material in the third energy recovery chamber during flow reversal process of vessels 1 and 2, and helps to minimize untreated process gas leaving the RTO, resulting in achieving a high DRE.

In the context of one plant producing painted metal components, as the painted metal are being cured through the process oven(s), the paint solvents evaporate into the oven's work chamber. In accordance with methods and systems of the present disclosure, the air laden with VOCs (oven exhaust) is extracted from the oven's work chamber and routed through the primary heat exchanger (utilizing ceramic material as medium, as described herein) of the RTO. The primary heat exchanger pre-heats the oven exhaust above about 650° C. (above about 1200° F.) temperature to minimize the RTO's combustion burner fuel consumption. The temperature in retention/purification chamber or combustion/retention chamber of the RTO is maintained around 815° C. (around 1500° F.). The VOC exothermic combustion reaction contributes in making the RTO's retention/purification chamber act as a self-sustaining agent, preferably without any additional burner heat input. When the solvent vapors oxidize, and the exothermic reactions take place, the solvent acts as fuel to the RTO; thus, further reducing the primary fuel cost of operating the RTO to an absolute minimum. To maintain purification/retention chamber temperature set point and avoid the high temperature shutdown in event of excess exothermic reaction due to high solvent concentration in the exhaust stream, a hot gas by-pass arrangement (motorized damper and insulated pipe) may be activated to extract excess heat from combustion/retention chamber (combustion/retention chamber).

The use of a secondary heat exchanger arrangement further establishes an efficient, economic solution. In certain embodiments, the contaminated air from coating room may be effectively captured and routed through an air-to-air heat exchanger (referred as secondary heat recovery). The secondary heat exchanger continues to supply the pre-heated air back to coating oven, thus increasing sustainability. The secondary heat exchanger utilizes the waste heat from the RTO before discharging the waste through an exhaust stack. Re-circulating contaminated coating room air as the source of heated air supply not only helps to reduce the RTO's required capacity, but also results in reducing the coating oven fuel consumption. An auxiliary or supplementary combustion burner may be provided in certain methods and systems to overcome additional heat demand from the oven zones.

In attempting to design the most energy efficient methods and systems, with the goal of conservation of all possible thermal energy contained in exhaust system, air-to-water indirect heater exchangers (referred to as tertiary heat recovery) may be employed. The waste heat contained in clean gases leaving the secondary heat exchanger may be further recovered by pre-heating water circulated in a closed loop coil. The heated water may then be utilized to pre-heat the re-circulating process water (using indirect heating) in a wash line, which minimizes the energy required to operate wash line equipment.

As demonstrated by this example metal coating operation, by continuously recycling the heat between the RTO and ovens via primary and secondary heat exchangers and acquiring further heat recovery through air to water heat exchanger (tertiary heat recovery), methods and systems of the present disclosure create optimal operational efficiency and allows facilities to capitalize on the thermal energy across the entire process.

In certain embodiments, motorized dampers may be employed on oven zones to control the hot air volume based on temperature sensor feedback.

Suitable secondary heat recovery sub-systems may comprise air-to-air indirect heat exchangers of plate and frame type, employing hot gas by-pass arrangement (heated combustion/retention chamber gases mix with RTO exhaust in a mixing chamber), and one or more supplementary or auxiliary combustion burner chambers. Contaminated coating room exhaust may be captured by one or more exhaust fans and routed between the plates of the secondary heat exchanger. The waste heat from the RTO exhaust may be routed over the plates of the secondary heat exchanger. The pre-heated (up to about 315° C., or about 600° F.) contaminated coating room exhaust may be supplied as heat source to the coater oven zones. The supplementary burner chamber may be added between the secondary heat exchanger and the coater oven zones to further heat the pre-heated contaminated coating room exhaust from the secondary heat exchanger up to about 650° C. (about 1200° F.). A distribution duct and motorized damper arrangement may be utilized to achieve temperature control in oven zones by controlling pre-heated contaminated coating room exhaust supplied to each coater oven zone.

Continuing with the metal coating operation example, the tertiary heat recovery system may consist of two indirect heat exchangers, a gas-to-water heat exchanger (economizer coil style) system, and a water-to-water indirect heat exchanger (hot water coil installed in water tank) with a closed loop arrangement for the heated water using a recirculation pump to circulate the heated water flow first in the gas-to-water indirect heat exchanger, followed by the heated water exchanging heat indirectly with a separate wash water solution in a wash station tank to heat the chemical solution or rinse water contained in the wash station equipment tank. There indirect exchange arrangement minimizes the energy required for heating solution in the wash station tank. The recirculation pump may constantly circulate water, and may be equipped with variable frequency drive to control the circulating water flow rate.

One or more recirculation blowers and one or more exhaust blowers may be used to control gas flows, providing positive and negative pressure where needed in the systems.

Various terms are used throughout this disclosure. "Indirect heating" as used herein means that a hot fluid exchanges heat with a cooler fluid, usually through one or more heat transfer surfaces such as plates or tubes, without mixing of the fluids.

As used herein the phrase "combustion gases" as used herein means substantially gaseous mixtures comprised primarily of combustion products, such as oxides of carbon (such as carbon monoxide, carbon dioxide), oxides of nitrogen, oxides of sulfur, and water, as well as partially combusted fuel, non-combusted fuel, and any excess oxidant. Combustion products may include liquids and solids, for example soot and unburned liquid fuels. "Burner exhaust", and "burner flue gas" are equivalent terms and refer to a combination of combustion gases and other effluent from combustion burners, such as adsorbed water, water of hydration, CO, $CO_2$ and $H_2O$ liberated from combustion of hydrocarbons, and the like. Therefore burner exhaust may comprise oxygen or other oxidants, nitrogen, combustion products (including but not limited to, carbon dioxide, carbon monoxide, $NO_x$, $SO_x$, $H_2S$, and water) and uncombusted fuel. "Exhaust" when used alone is equivalent to "effluent composition" and "contaminated gas", and are meant to represent "dirty" gaseous compositions comprising air combined with VOCs and/or HAPs emanating from a "source", such as a coating room, or coating oven. "Clean gas", "clean exhaust", and "clean effluent" are considered equivalent, and mean that gaseous composition that has passed through the RTO.

"Oxidant" as used herein includes air, gases having the same molar concentration of oxygen as air (for example "synthetic air"), oxygen-enriched air (air having oxygen concentration greater than 21 mole percent), and "pure" oxygen grades, such as industrial grade oxygen, food grade oxygen, and cryogenic oxygen. Oxygen-enriched air may have 50 mole percent or more oxygen, and in certain embodiments may be 90 mole percent or more oxygen. Primary, secondary, and tertiary oxidant are terms understood in the combustion burner art; burners employed herein may use any one or more of these.

The term "fuel", according to this disclosure, means a combustible composition comprising a major portion of, for example, methane, natural gas, liquefied natural gas, propane, butane, hydrogen, steam-reformed natural gas, atomized hydrocarbon oil, combustible powders and other flowable solids (for example coal powders, carbon black, soot, and the like), and the like. Fuels useful in the disclosure may comprise minor amounts of non-fuels therein, including oxidants, for purposes such as premixing the fuel with the oxidant, or atomizing liquid or particulate fuels. As used herein the term "fuel" includes gaseous fuels, liquid fuels, flowable solids, such as powdered carbon or particulate material, waste materials, slurries, and mixtures or other combinations thereof.

The sources of oxidant and fuel may be one or more conduits, pipelines, storage facilities, cylinders, or, in embodiments where the oxidant is air, ambient air. Oxygen-enriched oxidants may be supplied from a pipeline, cylinder, storage facility, cryogenic air separation unit, membrane permeation separator, or adsorption unit such as a vacuum swing adsorption unit.

"Oven" as used herein means industrial ovens, particularly paint bake ovens; or ovens for drying or curing other coatings. Ovens may be of various capacities, lengths and heat input. An "exterior" bake oven mean an oven used for baking or curing an exterior coating on a substrate. Ovens may be heated by various heating methods, such as burners, electric heating coils, or infrared heaters. Different ovens may exhaust into a common manifold, or separate holding containers to be mixed later. For drums, one oven may be used for drum lids, another oven for linings, and another oven for the prime bake oven. The combustion chambers and fans (not shown) may be mounted on top of an oven. Each combustion chamber may be equipped with, for example, one 3,500,000 BTU/hr. (3,700 (megajoule/hr.) burner and 30,000 $ft^3$/min. (850 $M^3$/min.) capacity recirculation fans. The ovens are capable of operating at 450°–500° F. Ovens may be of high velocity design and highly efficient using approximately 40 to 50 percent less fuel than a conventional convection oven. The exhaust from all of the ovens may be collected through manifold at a flow rate providing a 10 to 50 percent LEL, or 15 to 25 percent LEL, or about 25 percent LEL content of hydrocarbons released in the baking or curing operation (calculated on the basis of solvent input).

A "damper" is a well-known temperature control device, and may be controlled by a thermostat responsive to a temperature in question. For example, when hot water is circulating through a coil being indirectly heated by hot gas, when the hot water temperature reaches a predetermined level, a damper may be actuated to bypass the hot gas through a bypass conduit directly to a fan downstream of the heat exchanger without going through heat exchanger.

Referring now to the drawing figures, FIGS. 1, 2, 3, and 4 illustrate schematic process flow diagrams of four method and system embodiments 100, 200, 300, and 400, respectively, in accordance with the present disclosure. Each of embodiments 100, 200, 300, and 400 illustrated schematically in FIGS. 1-4, respectively, include an RTO, 2, having a combustion/retention chamber 10 and one or more combustion burners 12 for heating combustion/retention chamber 10 to a desired temperature, as described herein. Embodiment 100 features three energy recovery towers, or canisters 4, 6, and 8, each having therein a respective bed of ceramic material therein 14, 16, and 18. For ease of reference, energy recovery towers or canisters are simply referred to herein as vessels 4, 6, and 8. Embodiment 200 is similar to embodiment 100, but features five vessels rather than three. Embodiment 200 includes vessel 86 with ceramic material bed 88 therein, and vessel 90 with ceramic material bed 92. Ceramic material beds may be the same or different from vessel to vessel, in terms of chemical and physical makeup, as well as in terms of size (length, width, height, radius, diameter).

Embodiments 100 and 200 each further feature a process effluent RTO feed conduit 20, an RTO exhaust conduit 22, and an RTO hot gas bypass conduit 24. One or all conduits described herein may be insulated. RTO hot gas bypass conduit 24 further includes a temperature-operated control valve 26, such that one or more temperatures of the system and method may be monitored and used to control flow through control valve 26 and conduit 24, for example temperature of RTO exhaust in conduit 22. Bypass conduit 24 and RTO exhaust conduit 22 both are fluidly connected to a mixing chamber 28, which may also be insulated, and mixing chamber 28 is fluidly connected to a secondary heat exchanger 32 via a mixing chamber exhaust conduit 30. Secondary heat exchanger 32 is in turn fluidly connected to a tertiary heat exchanger 36 via a secondary heat exchanger exhaust conduit 34. In this way, by flow through conduits 22, 30, and 34, and secondary and tertiary heat exchangers 32, 36, thermal energy that would otherwise be wasted in hot RTO exhaust is used to preheat process streams, as described herein. Tertiary heat exchanger 36 is fluidly connected to a stack blower 40 and a stack 42 via a tertiary heat exchanger exhaust conduit 38, whereby cooled, clean RTO exhaust may be safely and cleanly released to the atmosphere.

Referring again to FIGS. 1 and 2, one or more process units 52, for example coating curing ovens, exhaust into a common insulated header, manifold, or conduit 50, urged by a process exhaust fan 48 that discharges into another insulated conduit 46. A backpressure control valve 44 controls flow of process unit exhaust through RTO feed conduit 20. Process units 52 each receive a portion of warmed exhaust from another process unit operation 64, for example a coating room or booth. The exhausts from process unit operation 64 and process units 52 contain VOCs and/or HAPs that must be substantially or completely removed prior to those exhausts being released to the atmosphere. Process unit exhaust is urged to flow through process unit operation exhaust conduit 66 by a secondary heat exchanger supply fan 68, which in turn exhausts through a conduit 70 into secondary heat exchanger 32 for indirect heat transfer of thermal energy from RTO exhaust. A process unit supply conduit 56 branches into a set of conduits and backpressure controllers 54 to control feed of warmed process unit operation exhaust back into process units 52. An auxiliary heater 58, which may be an electrical heater or combustion burner, supplies extra thermal energy if desired, and a process unit bypass conduit 60 and temperature controlled control valve 62 are provided to bypass flow from conduit 56 into conduit 20 as needed, for example if more than necessary thermal energy is being supplied to process units 52. Fresh air supply valves 72, 76, supply ambient air for cooling if necessary. Valves 72, 76 may be manual or automatic, for example operated using a thermostat. One or more pressure relief valves 74 may be present for safely relieving pressure to atmosphere, or to stack 42.

Completing embodiments 100 and 200 is a cool water supply conduit 82, a coil 80, and a heated water outlet conduit 78. In certain embodiments, conduits 78 and 82, along with coil 80, form a closed-loop water system. Heated water in conduit 78 may be caused to flow through another coil (not illustrated) in a plant for transferring heat to wash water or some other composition contained in a separate container, where the warmed wash water or other composition may be used for myriad purposes in coating plants. One such use is for washing metal components prior to applying primer, paint, or other coatings to metal components.

Figure 3:
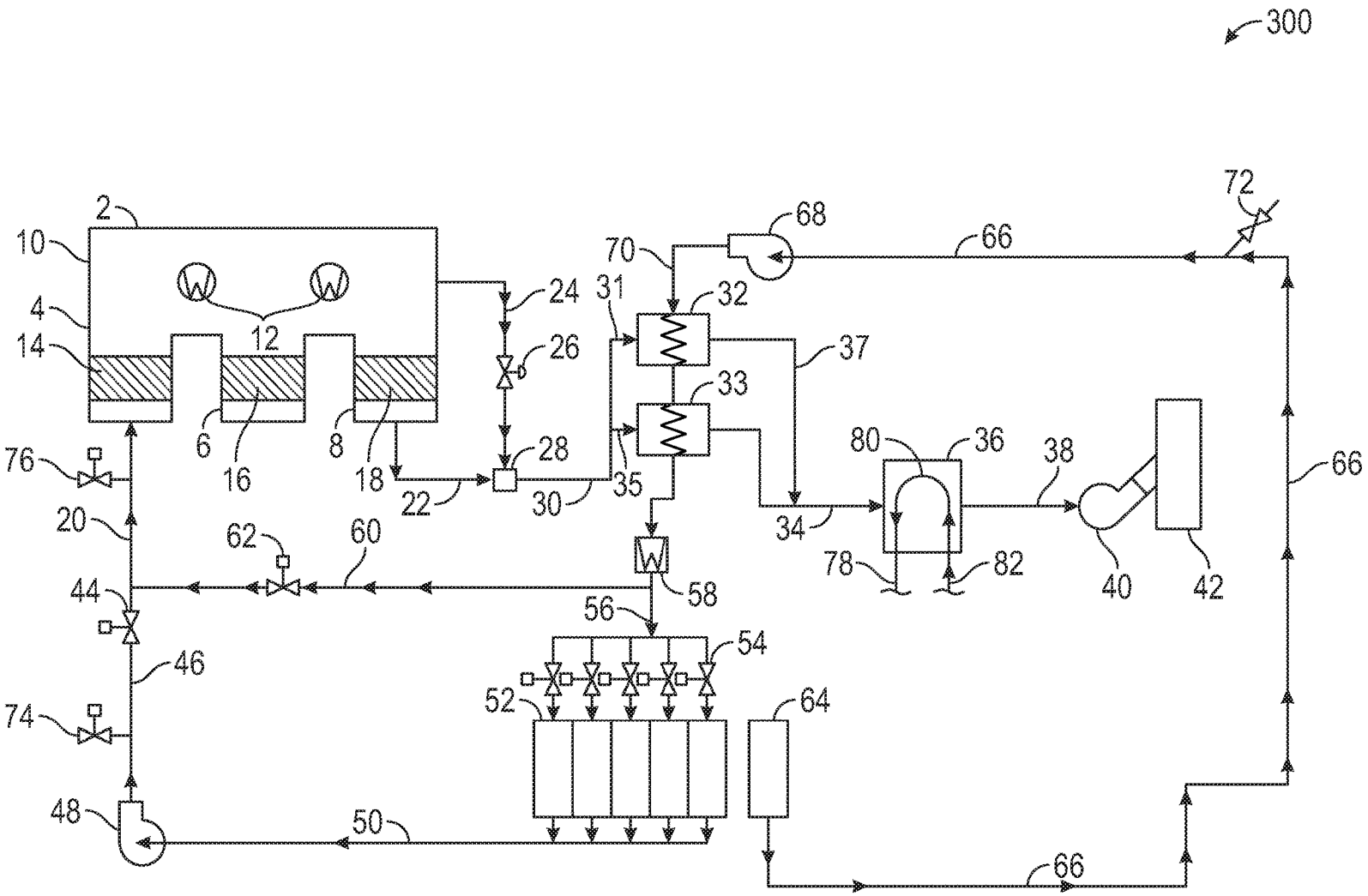
Figure 4:
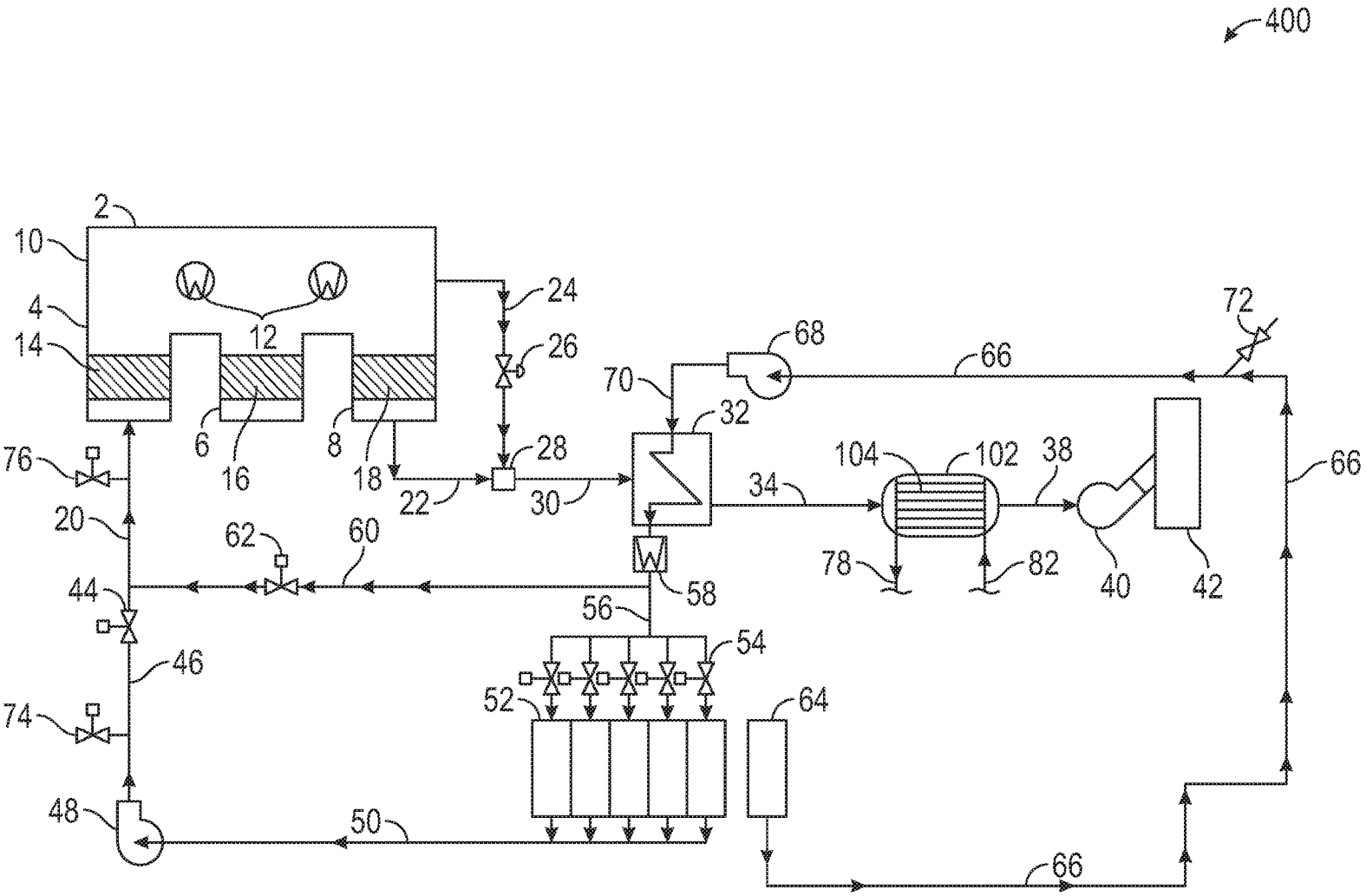

Referring now to FIGS. 3 and 4, these figures schematically illustrate two other system and method embodiments 300 and 400 of the present disclosure. Certainly other variations will be apparent to persons skilled in the heat transfer art. Embodiment 300 differs from embodiment 100 in having two secondary heat exchangers 32, 33, arranged in parallel with respect to flow of RTO exhaust, heat exchanger 32 being fed through a conduit 71, and heat exchanger 33 being fed through a conduit 35. A second outlet conduit 37 is also provided, fluidly connecting heat exchanger 32 with conduit 34. Alternatively, conduit 37 could fluidly connect directly to tertiary heat exchanger 36. Heat exchangers could, in certain embodiments, be sized to transfer one half the heat that exchanger 32 does on embodiment 100; alternatively, heat exchangers 32, and 33 could each be sized to handle the entire heat transfer load expected of the arrangement in embodiments 100 and 200, with heat exchanger 33 serving as a spare to heat exchanger 32, or vice versa, during maintenance operations. Embodiment 400, illustrated schematically in FIG. 4, differs from embodiment 100 by featuring a counterflow shell and tube heat exchanger 102, rather than a coil. Cool water supplied by conduit 82 feeds tubes 104 of heat exchanger 102, while conduit 78 routes heated water to a separate tank for heating wash water or other composition, as in embodiments 100 and 200. Cooled RTO exhaust is fed through conduit 34 and flows in the shell of shell and tube heat exchanger 102. In another variation (not illustrated), shell and tube heat exchanger 102 could be split into two separate shell and tube heat exchangers and fed in parallel with respect to feed of cooled RTO exhaust, or one could be employed as a spare while the other is undergoing maintenance.

Figure 5:
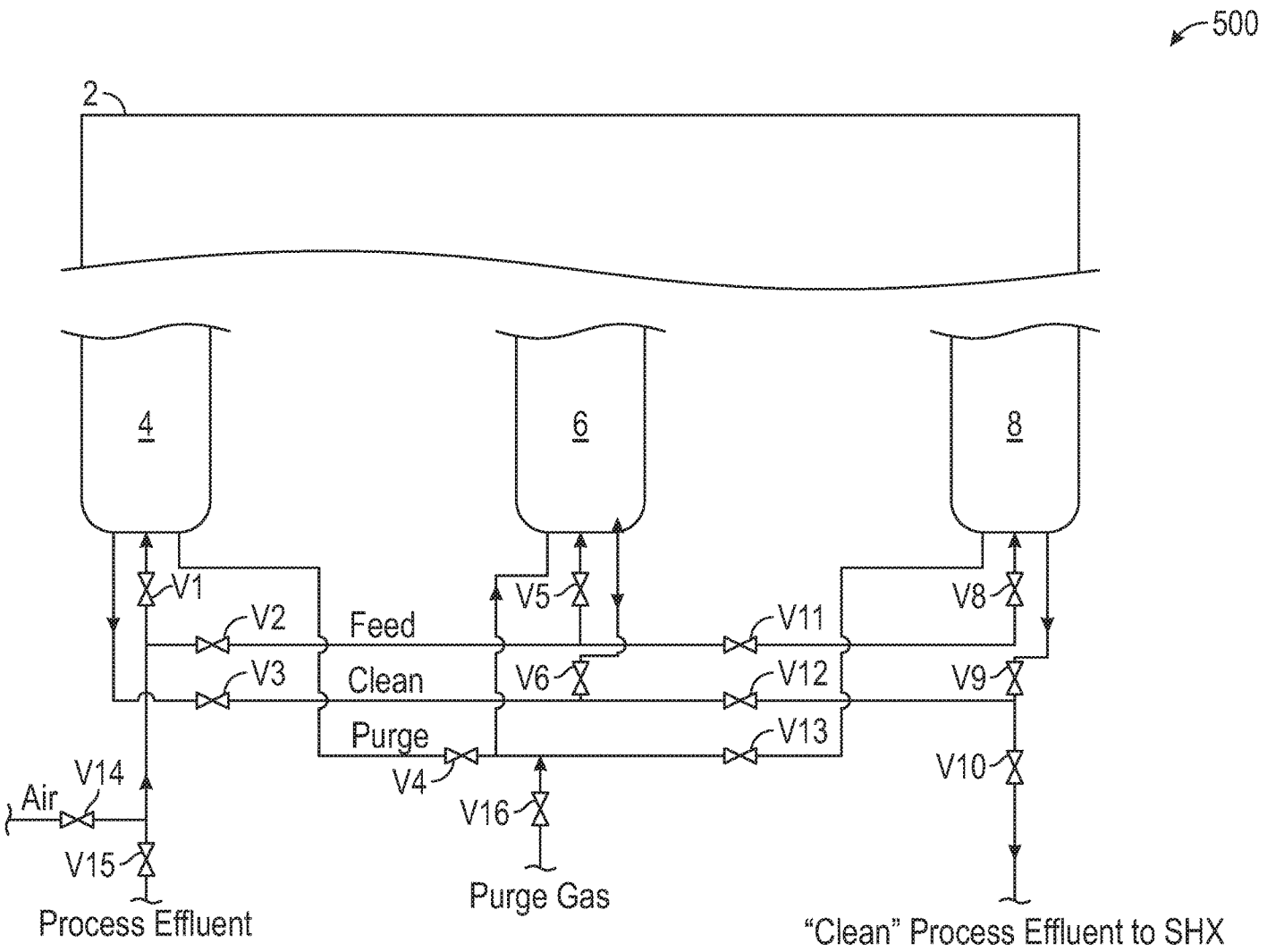
FIG. 5 is a schematic process flow diagram, with some parts cut away, illustrating one arrangement of manifolds and valves that may be useful in practicing the methods and using the systems of the present disclosure.

FIG. 5 illustrates schematically one embodiment 500 of inlet, outlet, and purge gas manifolds that may be used in practicing methods and systems of the present disclosure. A set of valves V1-V16 is illustrated, most likely operated by a master controller, such as a programmable logic controller (PLC). Table 1 lists four cycles, C1*a*, C2*a*, C1*b*, and C3*a*, representative of how the method and system of embodiment 100 (FIG. 1) might operate. The designations "0" for "open" and "C" for "closed" are used in Table 1 to denote the status of valves V1-V16 during each cycle. Cycle C1*a* would operate for a first time period ranging from about 150 to about 300 seconds, with vessel 4 receiving dirty process gas with a flow direction bottom to top, and vessel 6 operating with flow being top to bottom, after which the PLC switches valves as per Table 1 and the second cycle C2*a* operates for a second time period ranging from about 150 to about 300 seconds, with vessel 6 receiving dirty process gas with a flow direction bottom to top, and vessel 4 operating with flow from top to bottom. These cycles are repeated (repeating the first cycle (cycle C1*b*) and the second cycle (C2*b*), and so on) for a plurality of the first cycles and a plurality of the second cycles, whereby a sum of the first time periods and the second time periods equals a total time not less than one hour. During the plurality of first and second time periods, vessel 8 operates in purge mode, receiving a purge gas, such as ambient air, oxygen-enriched air, or industrial oxygen, whereby contaminants that were originally in the dirty process gas and have been deposited on ceramic material in vessel 8 are purged into combustion/retention chamber 10 of RTO 2, and combusted, thereby supplying further thermal energy to gases in combustion/retention chamber 10. After a time of not less than one hour, vessel 8 is ready to serve again, and cycle 3*a* is initiated, whereby vessels 4 and 8 are switched. Alternatively, vessels 6 and 8 may be switched.

TABLE 1

Example of Operating Embodiment 100, FIG. 5.

| | VALVE NUMBER | | | | | | | | | | | | | | | |
|---|---|---|---|---|---|---|---|---|---|---|---|---|---|---|---|---|
| Cycle | 1 | 2 | 3 | 4 | 5 | 6 | 7 | 8 | 9 | 10 | 11 | 12 | 13 | 14 | 15 | 16 |
| C1a | O | C | C | C | C | O | C | C | C | O | C | O | O | C | O | O |
| C2a | C | O | O | C | O | C | C | C | C | O | C | O | O | C | O | O |
| C1b | O | C | C | C | C | C | C | C | C | O | C | O | O | C | O | O |
| C2b | C | O | O | C | O | C | C | C | C | O | C | O | O | C | O | O |
| C3a | C | O | C | O | C | O | C | O | C | O | O | O | C | C | O | O |

Suitable circulation blowers have a capacity ranging from about 5,000 to about 50,000, CFM, or from about 10,000 to about 20,000 CFM, and may use an electric motor driver with variable flow, such as having a power of about 10 to about 30 HP, or from about 15 to 25 HP. Such blowers are commercially available, for example, from Twin City Fans & Blowers, Minneapolis, Minn.

During operation of embodiments 100, 200, 300 and 400 and other embodiments described herein, the heat exchange substructures and combustion/retention chamber may include one or more airflow diverters (baffles and the like) for effecting indirect heat exchange from hot air or hot combustion products. Streams may flow tortuously through the heat exchange substructure, on the outside or inside surfaces thereof, while hot air or hot combustion products flow tortuously on the opposite side of the heat transfer surfaces of the heat transfer substructures. Flow diverters may for example comprise one or more baffles, distributor plates, grids, and the like for causing a tortuous flow path. Flow diverters may take any shape, for example flat plates, corrugated plates, plates having a variety of projections or protuberances therefrom such as spikes, knobs, lumps, bumps, and the like, of a variety of sizes, or all the same size. In certain embodiments the relative flows through the heat exchange substructures may be counter-current, co-current, or crosscurrent (cross-flow). Flows may be continuous or semi-continuous (semi-batch) while there is a load of products in any particular oven or effluent composition source.

The methods and systems of the present disclosure are very efficient waste heat recovery methods and systems that also function as efficient air pollution control methods and systems. Referring to FIG. 1, the gaseous effluent containing VOC and/or HAPs from the several coating curing ovens 52 is collected through manifold 50 and has a hydrocarbon (or other combustible constituent) content of about 25% LEL and is at a temperature of about 350° F. (about 177° C.). The exhaust from the coating curing ovens is conducted through RTO 2 heat exchangers 8 and 10 where it is preheated to a temperature of 850°–900° F. and then introduced into incinerator grid burner 13. Burner 13 includes a plurality of gas fired burner flames that insure a total incineration of the hydrocarbon (or other combustible) constituents. The exhaust from the RTO has a hydrocarbon content which is below the limits established by EPA as acceptable for discharge to the atmosphere. The combustion effluent from RTO burners 12 may be at a temperature of about 1400° F. (about 760° C.), and RTO exhaust is passed into combustion/retention chamber 10 and then through heat exchangers 32 and 36 where it preheats the exhaust from a coater room 64 or other source from ambient temperature (which may range from about 70° F. to about 100° F. (about 21° C. to about 38° C.)) to about 900° F. (about 480° C.). The cooled RTO exhaust then has a temperature of about 450° F. to about 500° F. (about 232° C. to about 260° C.) on leaving heat exchanger 32. The cooled RTO effluent then passes over hot water coil 80 in heat exchanger 36 where the gases are cooled from about 500° F. (about 260° C.) to about 300° F. (about 149° C.) at the inlet to stack blower 40. This temperature drop of RTO effluent is effective to heat the hot water circulating through coil 80 to a temperature of about 275° F. (about 135° C.) at a pressure of about 100 psi (about 690 KPa) at a rate of about 300 GPM (about 68 $M^3$/hr.). The high pressure high temperature hot water from coil 80 may be circulated through conduit 78 to storage units (not illustrated) or directly to wash tanks (also not illustrated) for use in chemical wash lines and other cleaning operations. Optionally, cooler water may be mixed therein to produce water stored at a temperature of about 180° F. (about 82° C.). The RTO exhaust gas reaching insulated stack blower 40 may be at a temperature of about 300° F. (149° C.).

The system of heat exchangers, dryers, water wash lines and RTO illustrated schematically in FIG. 1 is operable to effect a substantially complete waste heat recovery from the exhaust gases in the ovens. Waste heat is effective to heat 9,000 gallons of water to 180° F. (about 82° C.) for chemical wash lines and other cleaning operations. The system produces sufficient gaseous effluent to provide 20,000 CFM air at 350° F. (about 177 C) to the five coating curing ovens 52. The net effect of the system is substantially total waste heat recovery and substantially complete oxidation of hydrocarbons to produce an effluent meeting air quality standards.

Insulating material may be mineral wool, glass wool or other insulating material. Conduits, combustion/retention chambers, heat exchangers and other equipment may comprise aluminized 18 gage carbon steel or stainless steel, such as 304 or other stainless steel. More exotic metals may be used for all or portions of these, if desired, such as precious metals and/or noble metals (or alloys). Noble metals and/or other exotic corrosion and/or fatigue-resistant materials include metals such as platinum (Pt), ruthenium (Ru), rhodium (Rh), palladium (Pd), silver (Ag), osmium (Os), iridium (Ir), and gold (Au); alloys of two or more noble metals; and alloys of one or more noble metals with a base metal may be employed. In certain embodiments a protective layer or layers or components may comprise an alloy attached to a base metal using brazing, welding or soldering of certain regions.

Figure 6A:
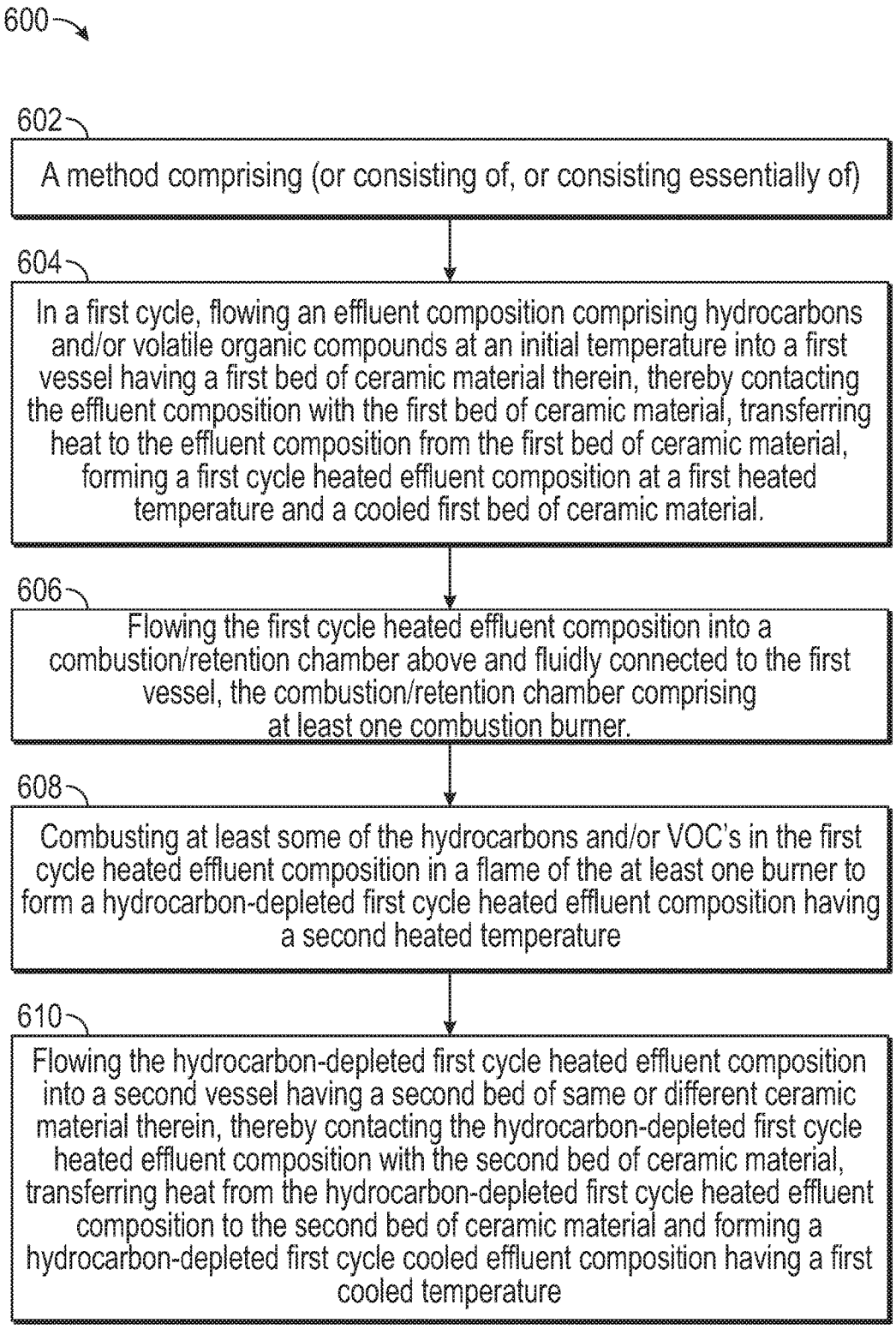
FIGS. 6A and 6B is a logic diagram of one method embodiment in accordance with the present disclosure.
Figure 6B:
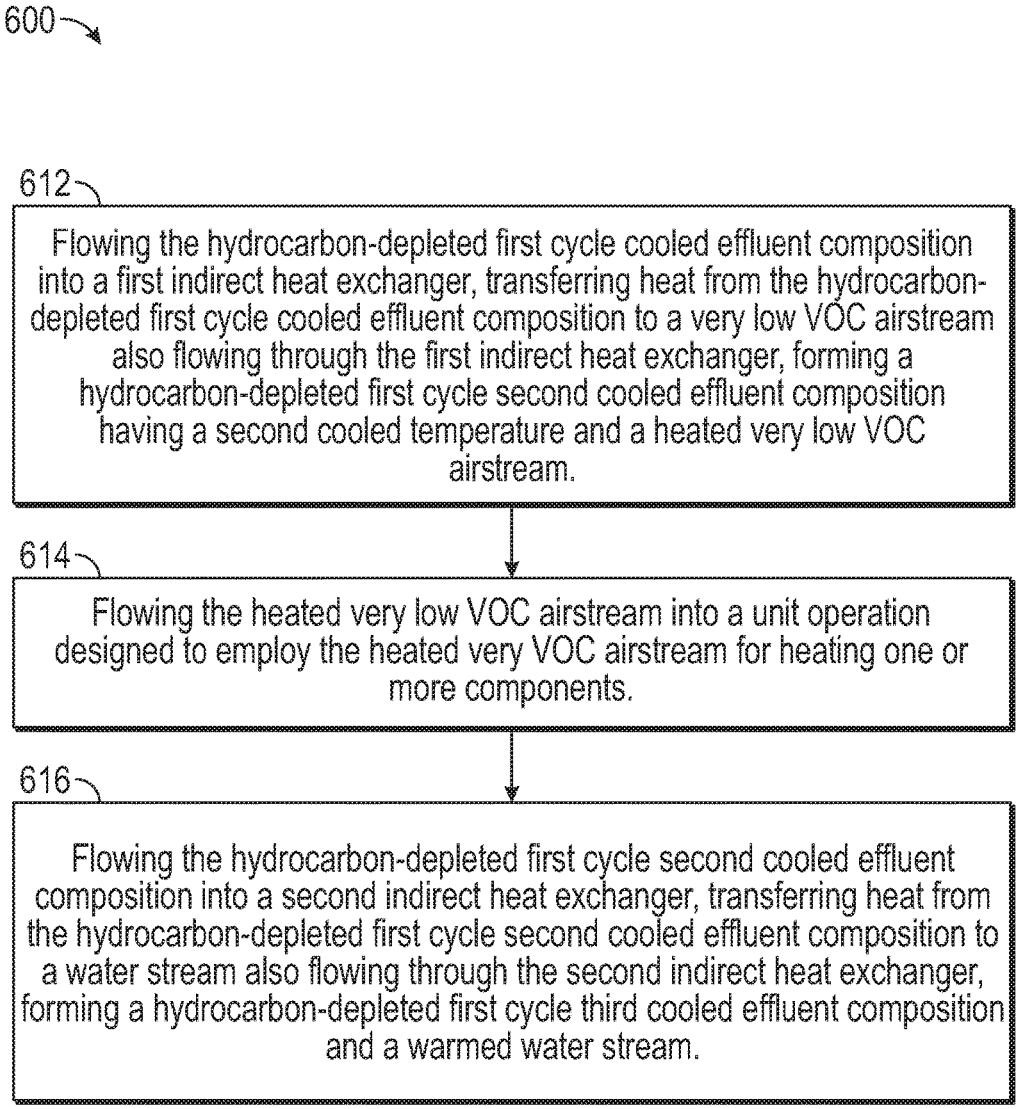

FIGS. 6A and 6B is a logic diagram of one method embodiment 600 in accordance with the present disclosure. Method embodiment 600 comprises (or in certain embodiments consists essentially of, or in yet other embodiments consists of)

Example 1

Design Detail of Regenerative Thermal Oxidizer with Secondary Heat Recovery Arrangement The claim is unique arrangement of cascading the air flow from sources of contaminated air (coating oven and coating room) using Regenerative Thermal Oxidizer and secondary and tertiary heat recovery system which helped to achieve maximum possible heat conservation through overall system arrangement.

The Overall system consisted 3-Canister Regenerative Thermal Oxidizer system with unique arrangement of Secondary Heat recovery mechanism to supply required heat (in form of pre-heated air) back to multi zone Coating Oven and Tertiary recovery mechanism to supply hot water for washing station equipment.

The Regenerative Thermal Oxidizer accepts the exhaust of coting Oven and destroy/eliminate the solvents and hydrocarbons (referred as VOC— Volatile Organic compounds) contained into oven exhaust stream up to level of 99%. The exhaust of thermal oxidizer system contained significant energy (heat) content which was recovered by utilizing indirect heat exchanger system which helped to capture and preheat contaminated coating room exhaust and use as heat source back to coating oven. To supply enough heat required to operate and maintain temperature in oven zones auxiliary/booster burner arrangement was added to the secondary hear recovery system. The motorized damper arrangement on oven zones were utilized to control amount of hot air volume based on temperature sensor feedback. The waste contained in secondary heat recovery system exhaust is further captured by utilizing indirect air to water heat exchanger to pre-heat circulating water and supplied as heat source to washing station equipment.

Secondary Heat Recovery System Details

The secondary heat recovery system consisted air to air indirect heat exchanger (Plate and frame type heat exchanger) system, hot gas by-pass arrangement and supplementary burner chamber. The contaminated coating room was captured and routed between the plates of heat exchanger. The waste heat from regenerative thermal oxidizer exhaust was routed over the plates of heat exchanger. The pre-heated (up to 600° F.) contaminated air was supplied as heat source to the oven zones. The supplementary burner chamber was added between secondary heat exchanger and Oven Zones to further heat the pre-heated air from secondary heat exchanger up to 1200° F. The distribution duct and motorized damper arrangement was utilized to achieve temperate control in oven zones by controlling hot air supply volume to each zone.

Tertiary Heat Recovery System Details

The tertiary heat recovery system consisted of two indirect heat exchangers, air to water heat exchanger (Economizer Coil style) system and water to water indirect heat exchanger (Hot water Coil installed in water tank) with closed loop arrangement using recirculation pump to circulate the water flow between indirect heat exchangers. The Air water to water heat exchanger recovers the waste heat contained in the exhaust gases leaving secondary heat recovery system by preheating the circulating water in the economizer coil. The heated water then circulated in the wash station tank to heat the chemical solution or rinse water contained in the wash station equipment tank. There indirect exchange arrangement minimizes the energy required for heating solution in the wash station tank. The recirculation pump constantly circulates water and equipped with variable frequency drive to control the circulating water flow rate.

Methods and systems of the present disclosure may include one or more thermocouples, temperature sensors, and/or other sensors for monitoring and/or control of temperature of the gas flows, for example using a controller. A signal may be transmitted by wire or wirelessly from a thermocouple or other sensor to a controller, which may control the method and system by adjusting any number of parameters, for example airflow rate may be adjusted through use of a signal to the air recirculation blower; one or more of flow rate of fuel and/or oxidant may be adjusted via one or more signals, it being understood that suitable transmitters and actuators, such as valves and the like, are not illustrated for clarity.

Methods and systems in accordance with the present disclosure may also comprise one or more oxy-fuel burners, but as they are only used in certain situations, are more likely to be air/fuel burners. In certain embodiments, all combustion burners and burner panels may be oxy/fuel burners or oxy-fuel burner panels (where "oxy" means oxygen, or oxygen-enriched air, as described earlier), but this is not necessarily so in all embodiments; some or all of the combustion burners or burner panels may be air/fuel burners. Furthermore, heating may be supplemented by electrical heating in certain embodiments, in certain zones. Oxy-fuel burners and technologies provide high heat transfer rates, fuel consumption reductions (energy savings), reduced volume of flue gas, and reduction of pollutant emission, such as oxides of nitrogen (NOx), carbon monoxide (CO), and particulates. Heat transfer fluids may be any gaseous, liquid, slurry, or some combination of gaseous, liquid, and slurry compositions that functions or is capable of being modified to function as a heat transfer fluid. Gaseous heat transfer fluids may be selected from air, including ambient air and treated air (for example, air treated to remove moisture), inorganic gases, such as nitrogen, argon, and helium, organic gases such as fluoro-, chloro- and chlorofluorocarbons, including perfluorinated versions, such as tetrafluoromethane, and hexafluoroethane, and tetrafluoroethylene, and the like, and mixtures of inert gases with small portions of non-inert gases, such as hydrogen. Heat transfer liquids and slurries may be selected from liquids and slurries that may be organic, inorganic, or some combination thereof, for example, water, salt solutions, glycol solutions, oils and the like. Other possible heat transfer fluids include steam (if cooler than the expected glass melt temperature), carbon dioxide, or mixtures thereof with nitrogen. Heat transfer fluids may be compositions comprising both gas and liquid phases, such as the higher chlorofluorocarbons.

In certain methods and systems, control of fuel and/or oxidant may be adjustable with respect to flow of the fuel or oxidant or both. Adjustment may be via automatic, semi-automatic, or manual control.

Certain system and method embodiments of this disclosure may be controlled by one or more controllers. For example, combustion (flame) temperature may be controlled by monitoring one or more parameters selected from velocity of the fuel, velocity of the primary oxidant, mass and/or volume flow rate of the fuel, mass and/or volume flow rate of the primary oxidant, energy content of the fuel, temperature of the fuel as it enters burners or burner panels, temperature of the primary oxidant as it enters burners or burner panels, temperature of the effluent (exhaust) at the burner exhaust exit, pressure of the primary oxidant entering burners or burner panels, humidity of the oxidant, burner or burner panel geometry, combustion ratio, and combinations thereof. Flow diverter positions may be adjusted or controlled to increase heat transfer in heat transfer substructures and exhaust conduits.

Various conduits, such as fuel and oxidant supply conduits, exhaust conduits, combustion/retention chambers, and airflow ducts of the present disclosure may be comprised of metal, ceramic, ceramic-lined metal, or combination thereof. Suitable metals include carbon steels, stainless steels, for example, but not limited to, 304 and 316 steel, as well as titanium alloys, aluminum alloys, and the like. High-strength materials like C-110 and C-125 metallurgies that are NACE qualified may be employed for burner body components. (As used herein, "NACE" refers to the corrosion prevention organization formerly known as the National Association of Corrosion Engineers, now operating under the name NACE International, Houston, Tex.) Use of high strength steel and other high strength materials may significantly reduce the wall thickness required, reducing weight of the systems and/or space required. In certain locations, precious metals and/or noble metals (or alloys) may be used for portions or all of these conduits. Noble metals and/or other exotic corrosion and/or fatigue-resistant materials such as platinum (Pt), ruthenium (Ru), rhodium (Rh), palladium (Pd), silver (Ag), osmium (Os), iridium (Ir), and gold (Au); alloys of two or more noble metals; and alloys of one or more noble metals with a base metal may be employed. In certain embodiments a protective layer or layers or components may comprise an 80 wt. percent platinum/20 wt. percent rhodium alloy attached to a base metal using brazing, welding or soldering of certain regions.

Suitable ceramic materials include acid ceramics (attacked by bases) such as silica and fireclay, basic ceramics (attacked by acid) such as magnesite, dolomite, and amphoteric or neutral ceramics, such as alumina, carbon, and silicon carbide. The fireclays (aluminosilicates) may be preferred, as well as silica, high alumina (form 70-80% $Al_2O_3$), mullite (clay-sand), magnesite (chiefly MgO dolomite, (CaO/MgO), forsterite (MgO/sand), carbon, chrome-ore magnesite, zirconia, and silicon carbide. The main requirements for use in methods and systems of the present disclosure are heat resistance for prolonged periods, stability, inertness, and the ability to be prepared in packed beds that allow flow of gases therethrough without significant pressure drop and channeling. Traditional ceramic packing materials, such as quartz gravel or alumina balls may be used. Other packing materials may include metallic materials such as steel or aluminum spheres. Suitable shapes for the ceramic or metallic materials may be any three-dimensional rectilinear bodies or any three-dimensional curvilinear bodies, and mixtures of two or more thereof. For example, spheres, pyramids (three-sided with a base and four-sided with a base), saddles, half-spheres, cylindrical, and conical shaped materials may be employed. Furthermore while generally the towers, canisters, or vessels are upright cylindrical vessels, other vessel configurations are suitable. Yet further, one vessel may include more than one ceramic material bed; for example, a single vessel may include a first bed of a first ceramic material having a first shape or mixtures of shaped ceramic pieces, while the second bed may have the same or different packing material. The different beds may be separated or layered, and may be supported by screens or grids in known fashion.

The choice of a particular material for any component is dictated among other parameters by the chemistry, pressure, and temperature of the effluent stream to be treated, fuel and oxidant used, and desired heat transfer and thermal energy characteristics. The skilled artisan, having knowledge of the particular application, pressures, temperatures, and available materials, will be able design the most cost effective, safe, and operable vessel, ceramic material beds, heat transfer substructures, feedstock and exhaust conduits, burners, burner panels, and ovens for each particular application without undue experimentation.

In burners used in the presently disclosed systems and methods, the velocity of the fuel in the various burners and/or burner panel embodiments depends on the burner/burner panel geometry used. The upper limit of fuel velocity depends primarily on the desired temperature of the hot combustion gases and the geometry of the burner; if the fuel velocity is too low, the flame temperature may be too low, providing inadequate temperature in the oven, which is not desired, and if the fuel flow is too high, flame and/or combustion products might impinge on a heat transfer surfaces or conduit walls, or be wasted, which is also not desired. Similarly, oxidant velocity should be monitored so that flame and/or combustion products do not impinge on heat transfer surfaces, or be wasted. Oxidant velocities depend on fuel flow rate and fuel velocity. Suitable burners include the nozzle-mixing, gas fired, ceramic-less burners known under the trade designation TUBE-O-THERM, from MAXON, and may have a heat output ranging from about 0.5 to about 10 million Btu/hr., or from about 0.5 to about 5 million Btu/hr. Such burners are able to burn natural gas, propane, butane, and LPG blends, and incorporate a gas and air valve linked together to control the gas/air ratio over the full throttling range of the burner. Gas flows through the gas nozzle where it mixes with the combustion air.

A combustion and/or Joule heating process control scheme may be employed. A master controller may be employed, but the disclosure is not so limited, as any combination of controllers could be used. The controller may be selected from PI controllers, PID controllers (including any known or reasonably foreseeable variations of these), and may compute a residual equal to a difference between a measured value and a set point to produce an output to one or more control elements. The controller may compute the residual continuously or non-continuously. Other possible implementations of the disclosure are those wherein the controller comprises more specialized control strategies, such as strategies selected from feed forward, cascade control, internal feedback loops, model predictive control, neural networks, and Kalman filtering techniques.

The term "control", used as a transitive verb, means to verify or regulate by comparing with a standard or desired value. Control may be closed loop, feedback, feed-forward, cascade, model predictive, adaptive, heuristic and combinations thereof. The term "controller" means a device at least capable of accepting input from sensors and meters in real time or near-real time, and sending commands directly to burner panel control elements, and/or to local devices associated with burner and RTO control elements able to accept commands. A controller may also be capable of accepting input from human operators; accessing databases, such as relational databases; sending data to and accessing data in databases, data warehouses or data marts; and sending information to and accepting input from a display device readable by a human. A controller may also interface with or have integrated therewith one or more software application modules, and may supervise interaction between databases and one or more software application modules.

The phrase "PID controller" means a controller using proportional, integral, and derivative features. In some cases the derivative mode may not be used or its influence reduced significantly so that the controller may be deemed a PI controller. It will also be recognized by those of skill in the control art that there are existing variations of PI and PID controllers, depending on how the discretization is performed. These known and foreseeable variations of PI, PID and other controllers are considered within the disclosure.

The controller may utilize Model Predictive Control (MPC). MPC is an advanced multivariable control method for use in multiple input/multiple output (MIMO) systems. MPC computes a sequence of manipulated variable adjustments in order to optimise the future behavior of the process in question. It may be difficult to explicitly state stability of an MPC control scheme, and in certain embodiments of the present disclosure it may be necessary to use nonlinear MPC. In so-called advanced control of various systems, PID control may be used on strong mono-variable loops with few or nonproblematic interactions, while one or more networks of MPC might be used, or other multivariable control structures, for strong interconnected loops. Furthermore, computing time considerations may be a limiting factor. Some embodiments may employ nonlinear MPC.

A feed forward algorithm, if used, will in the most general sense be task specific, meaning that it will be specially designed to the task it is designed to solve. This specific design might be difficult to design, but a lot is gained by using a more general algorithm, such as a first or second order filter with a given gain and time constants.

Although only a few exemplary embodiments of this disclosure have been described in detail above, those skilled in the art will readily appreciate that many modifications are possible in the exemplary embodiments without materially departing from the novel teachings and advantages of this disclosure. Accordingly, all such modifications are intended to be included within the scope of this disclosure as defined in the following claims. In the claims, no clauses are intended to be in the means-plus-function format allowed by 35 U.S.C. § 112, Section F, unless "means for" is explicitly recited together with an associated function. "Means for" clauses are intended to cover the structures, materials, and/or acts described herein as performing the recited function and not only structural equivalents, but also equivalent structures.

What is claimed is:

1. A method comprising:

(a) in a first cycle, flowing an effluent composition comprising hydrocarbons and/or volatile organic compounds at an initial temperature into a first vessel having a first bed of ceramic material therein, thereby contacting the effluent composition with the first bed of ceramic material, transferring heat to the effluent composition from the first bed of ceramic material, forming a first cycle heated effluent composition at a first heated temperature and a cooled first bed of ceramic material;

(b) flowing the first cycle heated effluent composition into a combustion/retention chamber above and fluidly connected to the first vessel, the combustion/retention chamber comprising at least one combustion burner;

(c) combusting at least some of the hydrocarbons and/or VOCs in the first cycle heated effluent composition in a flame of the at least one burner to form a hydrocarbon-depleted first cycle heated effluent composition having a second heated temperature;

(d) flowing the hydrocarbon-depleted first cycle heated effluent composition into a second vessel having a second bed of same or different ceramic material therein, thereby contacting the hydrocarbon-depleted first cycle heated effluent composition with the second bed of ceramic material, transferring heat from the hydrocarbon-depleted first cycle heated effluent composition to the second bed of ceramic material and forming a hydrocarbon-depleted first cycle cooled effluent composition having a first cooled temperature;

(e) flowing the hydrocarbon-depleted first cycle cooled effluent composition into a first indirect heat exchanger, transferring heat from the hydrocarbon-depleted first cycle cooled effluent composition to a very low VOC airstream also flowing through the first indirect heat exchanger, forming a hydrocarbon-depleted first cycle second cooled effluent composition having a second cooled temperature and a heated very low VOC airstream;

(f) flowing the heated very low VOC airstream into a unit operation designed to employ the heated very VOC airstream for heating one or more components;

(g) flowing the hydrocarbon-depleted first cycle second cooled effluent composition into a second indirect heat exchanger, transferring heat from the hydrocarbon-depleted first cycle second cooled effluent composition to a water stream also flowing through the second indirect heat exchanger, forming a hydrocarbon-depleted first cycle third cooled effluent composition and a warmed water stream.

2. The method of claim 1 comprising flowing a clean purge airstream through a third vessel having a third bed of same or different ceramic material therein, thereby purging the third bed of ceramic material of detritus collected therein and forming a dirty purge stream, and routing the dirty purge stream into the combustion/retention chamber for combusting at least some of the detritus.

3. The method of claim 2 comprising a second cycle, reversing flow through the first and second vessels so that the effluent composition flows first through the second vessel, creating a second cycle heated effluent composition and a cooled second bed of ceramic material, the second heated effluent composition flowing into the combustion/retention chamber where some of the hydrocarbons/VOCs are consumed to form a hydrocarbon-depleted second cycle heated effluent composition.

4. The method of claim 3 comprising operating the first cycle and the second cycle so that the first cycle operates for a first time period ranging from 150 to 300 seconds, and the second cycle operates for a second time period ranging from about 150 to about 300 seconds, and repeating the first cycle and the second cycle for a plurality of the first cycles and a plurality of the second cycles, whereby a sum of the first time periods and the second time periods equals a total time not less than one hour.

5. The method of claim 4 comprising a third cycle after the total time has expired comprising switching the flowing of the clean purge airstream from flowing through the third vessel having the third bed of same or different ceramic material therein to flowing the clean purge airstream through the first vessel and the first bed of ceramic material, while simultaneously switching the flowing of the effluent composition to flow through the third vessel and the third bed of ceramic material, thereby purging the first bed of ceramic material of detritus collected therein and forming a second dirty purge stream, routing the second dirty purge stream into the combustion/retention chamber for combusting at least some of detritus in the second dirty purge stream.

6. The method of claim 4 comprising a third cycle after the total time has expired comprising switching the flowing of the clean purge airstream from flowing through the third vessel having the third bed of same or different ceramic material therein to flowing the clean purge airstream through the second vessel and the second bed of ceramic material, while simultaneously switching the flowing of the effluent composition to flow through the third vessel and the third bed of ceramic material, thereby purging the second bed of ceramic material of detritus collected therein and forming a second dirty purge stream, routing the second dirty purge stream into the combustion/retention chamber for combusting at least some of detritus in the second dirty purge stream.

7. The method of claim 2 wherein the combustion/retention chamber encompasses an upper end of the first vessel, an upper end of the second vessel, and an upper end of the third vessel, and confines flow of the effluent composition, the first cycle heated effluent composition, and the dirty purge stream therein.

8. The method of claim 2 wherein the detritus in the dirty purge stream are combusted in the combustion/retention chamber and contribute to forming the hydrocarbon-depleted first cycle heated effluent composition.

9. The method of claim 1 wherein the combustion/retention chamber encompasses an upper end of the first vessel and an upper end of the second vessel, and confines flow of the effluent composition and the first cycle heated effluent composition therein.

10. The method of claim 1 wherein the combustion/retention chamber is maintained at a temperature ranging from 700° C. to 900° C.

11. A regenerative thermal oxidation method with secondary and tertiary heat recovery, the method comprising:

(a) in a first cycle, flowing an effluent composition comprising hydrocarbons and/or volatile organic compounds at an initial temperature into a first vessel having a first bed of ceramic aluminosilicate material therein, thereby contacting the effluent composition with the first bed of ceramic material, transferring heat to the effluent composition from the first bed of ceramic aluminosilicate material, forming a first cycle heated effluent composition at a first heated temperature and a cooled first bed of ceramic aluminosilicate material;

(b) flowing the first cycle heated effluent composition into a combustion/retention chamber above and fluidly connected to the first vessel, the combustion/retention chamber comprising at least one combustion burner;

(c) combusting at least some of the hydrocarbons and/or VOCs in the first cycle heated effluent composition in a flame of the at least one burner to form a hydrocarbon-depleted first cycle heated effluent composition having a second heated temperature;

(d) flowing the hydrocarbon-depleted first cycle heated effluent composition into a second vessel having a second bed of same or different ceramic aluminosilicate material therein, thereby contacting the hydrocarbon-depleted first cycle heated effluent composition with the second bed of ceramic aluminosilicate material, transferring heat from the hydrocarbon-depleted first cycle heated effluent composition to the second bed of ceramic aluminosilicate material and forming a hydrocarbon-depleted first cycle cooled effluent composition having a first cooled temperature;

(e) flowing the hydrocarbon-depleted first cycle cooled effluent composition into a first indirect heat exchanger, transferring heat from the hydrocarbon-depleted first cycle cooled effluent composition to a very low VOC airstream also flowing through the first indirect heat exchanger, forming a hydrocarbon-depleted first cycle second cooled effluent composition having a second cooled temperature and a heated very low VOC airstream;

(f) flowing the heated very low VOC airstream into a unit operation designed to employ the heated very VOC airstream for heating one or more components;

(g) flowing the hydrocarbon-depleted first cycle second cooled effluent composition into a second indirect heat exchanger, transferring heat from the hydrocarbon-depleted first cycle second cooled effluent composition to a water stream also flowing through the second indirect heat exchanger, forming a hydrocarbon-depleted first cycle third cooled effluent composition and a warmed water stream;

(h) flowing a clean purge airstream through a third vessel having a third bed of same or different ceramic material therein, thereby purging the third bed of ceramic material of detritus collected therein and forming a dirty purge stream, and routing the dirty purge stream into the combustion/retention chamber for combusting at least some of the detritus; and (i) a second cycle, comprising reversing flow through the first and second vessels so that the effluent composition flows first through the second vessel, creating a second cycle heated effluent composition and a cooled second bed of ceramic material, the second heated effluent composition flowing into the combustion/retention chamber where some of the hydrocarbons/VOCs are consumed to form a hydrocarbon-depleted second cycle heated effluent composition.

12. The method of claim 11 comprising operating the first cycle and the second cycle so that the first cycle operates for a first time period ranging from 120 to 300 seconds, and the second cycle operates for a second time period ranging from about 120 to about 300 seconds, and repeating the first cycle and the second cycle for a plurality of the first cycles and a plurality of the second cycles, whereby a sum of the first time periods and the second time periods equals a total time not less than one hour.

13. The method of claim 12 comprising a third cycle after the total time has expired comprising switching the flowing of the clean purge airstream from flowing through the third vessel having the third bed of same or different ceramic material therein to flowing the clean purge airstream through the first vessel and the first bed of ceramic material, while simultaneously switching the flowing of the effluent composition to flow through the third vessel and the third bed of ceramic material, thereby purging the first bed of ceramic material of detritus collected therein and forming a second dirty purge stream, routing the second dirty purge stream into the combustion/retention chamber for combusting at least some of detritus in the second dirty purge stream.

14. The method of claim 12 comprising a third cycle after the total time has expired comprising switching the flowing of the clean purge airstream from flowing through the third vessel having the third bed of same or different ceramic material therein to flowing the clean purge airstream through the second vessel and the second bed of ceramic material, while simultaneously switching the flowing of the effluent composition to flow through the third vessel and the third bed of ceramic material, thereby purging the second bed of ceramic material of detritus collected therein and forming a second dirty purge stream, routing the second dirty purge stream into the combustion/retention chamber for combusting at least some of detritus in the second dirty purge stream.

15. A system comprising:

(a) a regenerative thermal oxidizer (RTO), the RTO comprising at least three vessels open at their top to a common combustion/retention chamber, the combustion/retention chamber comprising at least one combustion burner configured to combust materials inside the combustion/retention chamber, the at least three vessels comprising a first vessel, a second vessel and a third vessel, each of the first, second, and third vessels having a same or different bed of ceramic material therein;

(b) a first indirect heat exchanger fluidly connected to the RTO via an RTO outlet conduit, the first indirect heat exchanger configured to be fluidly connected to a source of low VOC air via a low VOC source conduit, and configured to be fluidly connected to a unit operation requiring heated air by a heated low VOC air conduit;

(c) a second indirect heat exchanger fluidly connected to the first indirect heat exchanger via a first cooled effluent composition conduit, the second indirect heat exchanger configured to be fluidly connected to a stack via a second cooled effluent composition conduit;

(e) a manifold and valving sub-assembly comprising an inlet manifold and an outlet manifold, each of the inlet manifold and the outlet manifold having valves sufficient to alternate flow to and from the first vessel, the second vessel, and the third vessel of the RTO in a regenerative heat transfer and pollution reduction process, wherein the manifold and valving sub-assembly is configured to operate at least one of the vessels in a purge mode, whereby purged material is exhausted into the combustion/retention chamber.

16. The system of claim 15 comprising a hot gas bypass conduit and damper fluidly connecting the combustion/retention chamber and the RTO outlet conduit.

17. The system of claim 16 comprising an RTO exhaust and hot gas bypass mixing chamber fluidly connected to the RTO outlet conduit, the hot gas bypass conduit, and a mixed stream conduit fluidly connecting the mixing chamber with the first indirect heat exchanger.

18. The system of claim 15 comprising a process bypass conduit and control valve fluidly connecting the RTO inlet conduit and the heated low VOC air conduit.

19. The system of claim 15 comprising an auxiliary burner configured to exhaust into the heated low VOC air conduit.

20. The system of claim 15 comprising the second indirect heat exchanger fluidly connected to a water source conduit, a coil, and a heated water outlet conduit.

* * * * *